US008893628B2

(12) United States Patent
McKenzie, III et al.

(10) Patent No.: US 8,893,628 B2
(45) Date of Patent: Nov. 25, 2014

(54) DISPATCH DESK WITH FOCAL LENGTH ADJUSTABILITY

(71) Applicants: Clifton Kenneth McKenzie, III, Bainbridge Island, WA (US); Quint Allen Andrae, Tacoma, WA (US); Robert Benjamin Lanfear, Hansville, WA (US)

(72) Inventors: Clifton Kenneth McKenzie, III, Bainbridge Island, WA (US); Quint Allen Andrae, Tacoma, WA (US); Robert Benjamin Lanfear, Hansville, WA (US)

(73) Assignee: Watson Furniture Group, Inc., Poulsbo, WA (US)

( * ) Notice: Subject to any disclaimer, the term of this patent is extended or adjusted under 35 U.S.C. 154(b) by 0 days.

(21) Appl. No.: 13/784,631

(22) Filed: Mar. 4, 2013

(65) Prior Publication Data

US 2014/0245932 A1 Sep. 4, 2014

(51) Int. Cl.
*A47B 37/00* (2006.01)
*A47B 21/02* (2006.01)

(52) U.S. Cl.
CPC ..... *A47B 21/02* (2013.01)
USPC ..... 108/50.01

(58) Field of Classification Search
CPC ..... A47B 21/00; A47B 21/0314; A47B 21/0073; A47B 21/02; A47B 21/03
USPC ..... 108/50.01, 50.02, 147, 147.19, 143, 7, 108/10; 312/223.1, 223.3, 195
See application file for complete search history.

(56) References Cited

U.S. PATENT DOCUMENTS

| | | | | |
|---|---|---|---|---|
| 4,714,025 | A | 12/1987 | Wallin | |
| 4,852,500 | A * | 8/1989 | Ryburg et al. | 108/50.01 |
| 5,437,235 | A * | 8/1995 | Randolph | 312/223.3 |
| 5,537,290 | A | 7/1996 | Brown | |
| 5,845,587 | A | 12/1998 | Ditonto | |
| 5,988,076 | A * | 11/1999 | Vander Park | 108/50.02 |
| 6,099,093 | A * | 8/2000 | Spence | 312/223.3 |
| 6,220,181 | B1 * | 4/2001 | Horski | 108/50.01 |
| 6,296,408 | B1 * | 10/2001 | Larkin et al. | 400/682 |
| 6,360,675 | B1 * | 3/2002 | Jones | 108/50.02 |
| 6,398,326 | B1 * | 6/2002 | Wang | 108/50.01 |
| 6,986,556 | B2 * | 1/2006 | Haberman | 108/50.01 |
| 6,990,909 | B2 * | 1/2006 | Gosling et al. | 108/50.02 |
| 7,008,028 | B2 * | 3/2006 | Probst | 108/50.01 |
| 7,316,378 | B1 | 1/2008 | Curran | |
| 7,490,559 | B2 * | 2/2009 | Bentschneider | 108/50.01 |

(Continued)

OTHER PUBLICATIONS

"DL5/DL6 System," User Manual, DESKLINE®: Improving Ergonomics, Linak A/S, Nordborg, Denmark, May 25, 2011, 28 pages.

*Primary Examiner* — Jose V Chen
(74) *Attorney, Agent, or Firm* — Christensen O'Connor Johnson Kindness PLLC

(57) ABSTRACT

An ergonomic workstation (100) includes a plurality of lifting columns (106) that support a work surface assembly (120) including a lower support structure (121) that supports an upper work surface (131) suspended over the lower support structure and is configured to be movable between a retracted position and an extended position. A bifurcated dashboard assembly (123) includes a back portion (124) fixed to the support and a front portion fixed to the upper work surface. A monitor support structure (140) is fixed to the support structure, and includes a second lifting column (146) with a curved horizontal support (144) configured to support a plurality of monitors (90). The vertical position of the monitors is adjustable, but the horizontal position is fixed. The user focal length is adjustable by slidably adjusting the upper work surface.

20 Claims, 6 Drawing Sheets

(56) References Cited

U.S. PATENT DOCUMENTS

| | | | | |
|---|---|---|---|---|
| 7,640,866 | B1 * | 1/2010 | Schermerhorn | 108/50.02 |
| 7,721,658 | B2 * | 5/2010 | Seeley et al. | 108/50.01 |
| 7,878,476 | B2 | 2/2011 | Carson | |
| 8,051,782 | B2 | 11/2011 | Nethken | |
| 8,196,526 | B2 * | 6/2012 | Rheault et al. | 108/50.01 |
| 8,276,523 | B2 * | 10/2012 | Miller et al. | 108/50.02 |
| 8,312,820 | B2 * | 11/2012 | Rotlevi et al. | 108/50.01 |
| 8,485,111 | B2 * | 7/2013 | Chinuki et al. | 108/50.01 |
| 8,567,735 | B2 * | 10/2013 | Burgess et al. | 248/280.11 |
| 8,662,605 | B2 * | 3/2014 | McRorie et al. | 108/50.01 |
| 2003/0110989 | A1 * | 6/2003 | Chuang | 108/50.01 |
| 2003/0196573 | A1 * | 10/2003 | Fischer | 108/50.01 |
| 2005/0022699 | A1 * | 2/2005 | Goza | 108/50.01 |
| 2005/0217540 | A1 | 10/2005 | Novak | |
| 2013/0255544 | A1 * | 10/2013 | Scharing | 108/50.01 |

* cited by examiner

DISPATCH DESK WITH FOCAL LENGTH ADJUSTABILITY

BACKGROUND

Desks and workstations in use today are predominantly conventionally designed furniture having a relatively large, flat, and fixed horizontal working surface. Research into the health implications of a one-size-fits-all approach to such furniture suggests that workers may be more alert and more productive in a working environment that can be adjusted to the user's particular needs and preferences. Much of the progress in this area has been directed to the user's chair, for example providing adjustment functions that enable a custom comfortable fit and desired support. More recently, ergonomically designed workstations have become available wherein the workstation is designed to provide a better fit to the user rather than requiring the user to accommodate to the workstation. Ergonomic improvements include, for example, angled work surfaces that are designed to comfortably support the user's arms, height-adjustable work surfaces, foot supports, and the like. Such ergonomic improvements are all generally directed to increasing the user's comfort, particularly over longer periods of time, and to preventing injuries such as repetitive motion injuries.

Moreover, in some application, for example in emergency dispatch rooms, a particular workstation may be used by different dispatchers at different times, and therefore is preferably adjustable in relevant ways to accommodate the needs and preferences of different users. Of course, the emergency nature of the calls and the inherent stress in an emergency dispatch environment, and the importance of avoiding any errors, further mandates that such workstations provide adequate ergonomic assistance to the users.

Prior art desks and workstations have been proposed that provide certain ergonomic features. For example, desks are available that have an adjustable-height work surface, which may also be angle-adjustable.

In U.S. Pat. No. 8,051,782, to Nethken et al., which is hereby incorporated by reference, an ergonomic desk is disclosed having a work surface or table section and monitor display stand that are both mounted on a movable sled assembly, such that the work surface and monitors can be moved together as a unit by the user forward and rearward using an electronically controllable sled drive. The monitor display stand can also be moved vertically to adjust the height of the monitor relative to the work surface.

It is ergonomically beneficial to provide users with a height-adjustable work surface. However, Nethken et al. discloses an apparatus wherein the forward/rearward position of the monitor display stand is fixed with respect to the forward/rearward position of the work surface, which are both supported by the sled assembly.

It is known that users generally have a preferred or optimal viewing distance or "focal distance" from a monitor that varies from user to user. The "focal distance," as used herein refers to the distance between a user's eyes and the front face of the monitor. As noted in U.S. Pat. No. 7,878,476, to Carson et al., which is hereby incorporated by reference, "Inappropriate focal lengths or distance from the eye to the computer screen can cause visual fatigue, headaches or other symptoms of eye strain." It is also believed that the optimal focal distance for a particular user may vary, depending on a variety of factors, including the nature of the items being viewed on the monitor, the time of day and the user's level of fatigue, ambient lighting conditions, and the like. Therefore, it is ergonomically desirable to provide users with the ability to adjust the focal length.

As best understood, Carson et al. discloses a computer monitor mounting apparatus for mounting a plurality of monitors that includes a frame for supporting the monitors that is attached to a platform with at least one guide having one or more wheels or rollers for rolling the platform on the work surface. The user can therefore adjust the focal length by moving the guide-mounted platform forward or rearward across the work surface. It may be difficult or undesirable, however, to move a large monitor or array of monitors horizontally. The difficulty may be particularly evident when the monitor or array of monitors are mounted on an upright support structure that is attached to the workstation at its base, because of the dynamic bending moments that can be generated in the support structure when moving the monitors.

Additionally, for ergonomic optimization it would be advantageous for a particular user of a workstation to be able to adjust the height of the work surface, and independently adjust the height of the monitor(s) supported on the workstation.

There remains a need for a desk, workstation, or the like that supports one or a plurality of monitors wherein the user can adjust the vertical position of the monitors, and the focal length between the user and the monitor, without requiring moving the monitors horizontally.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A workstation for use with a plurality of monitors includes height and focal distance adjustability for the monitors that is achieved without requiring moving the monitors horizontally. The workstation includes a plurality of lower lifting columns that are attached to a lower support structure. A work surface is suspended over the lower support structure, and can be moved horizontally between a retracted position and an extended potion. A monitor support assembly is attached to the lower support structure, and includes upper lifting columns and a curved transverse support configured for mounting the monitors. A utility enclosure assembly includes a first portion attached to the back of the work surface. The elevation of the work surface is adjustable by the lower lifting columns, and the height of the monitors is independently adjustable by the upper lifting columns. The focal length for the user is independently adjustable by sliding the work surface between the retracted and extended positions. The horizontal position of the monitors is fixed with respect to the lower support structure. In an embodiment the work surface is attached to the lower support structure with left and right slides having first portions that extend from the work surface, and second portions that extend from the lower support structure. In an embodiment, the upper work surface includes separate control panels for controlling the upper and lower lifting columns.

In an embodiment the utility enclosure defines a user-accessible enclosure that moves with the upper work surface when the upper work surface is moved between the retracted position and the extended position, and the utility enclosure encloses one or more power strips, wherein one or more power strips may be fixed with respect to the support structure, and one or more power strips may be fixed with respect to the movable work surface.

In an embodiment, the monitor support assembly mounts the plurality of monitors horizontally, along a substantially circular arc.

An ergonomic workstation includes a plurality of first lifting column linear actuators adjustably supporting a lower support structure; a work surface attached to the lower support structure with a plurality of slides such that the work surface is movable between a retracted position and an extended position; a second lifting column linear actuator attached to the lower support structure, and a curved monitor support fixed to the second lifting column; and a dashboard assembly comprising a front portion attached to a back end of the work surface and a separable back portion attached to a back end of the lower support structure; wherein the plurality of first lifting column linear actuators are configured to selectively adjust the elevation of the work surface, and the second lifting column linear actuator is configured to selectively adjust the height of the curved monitor support.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
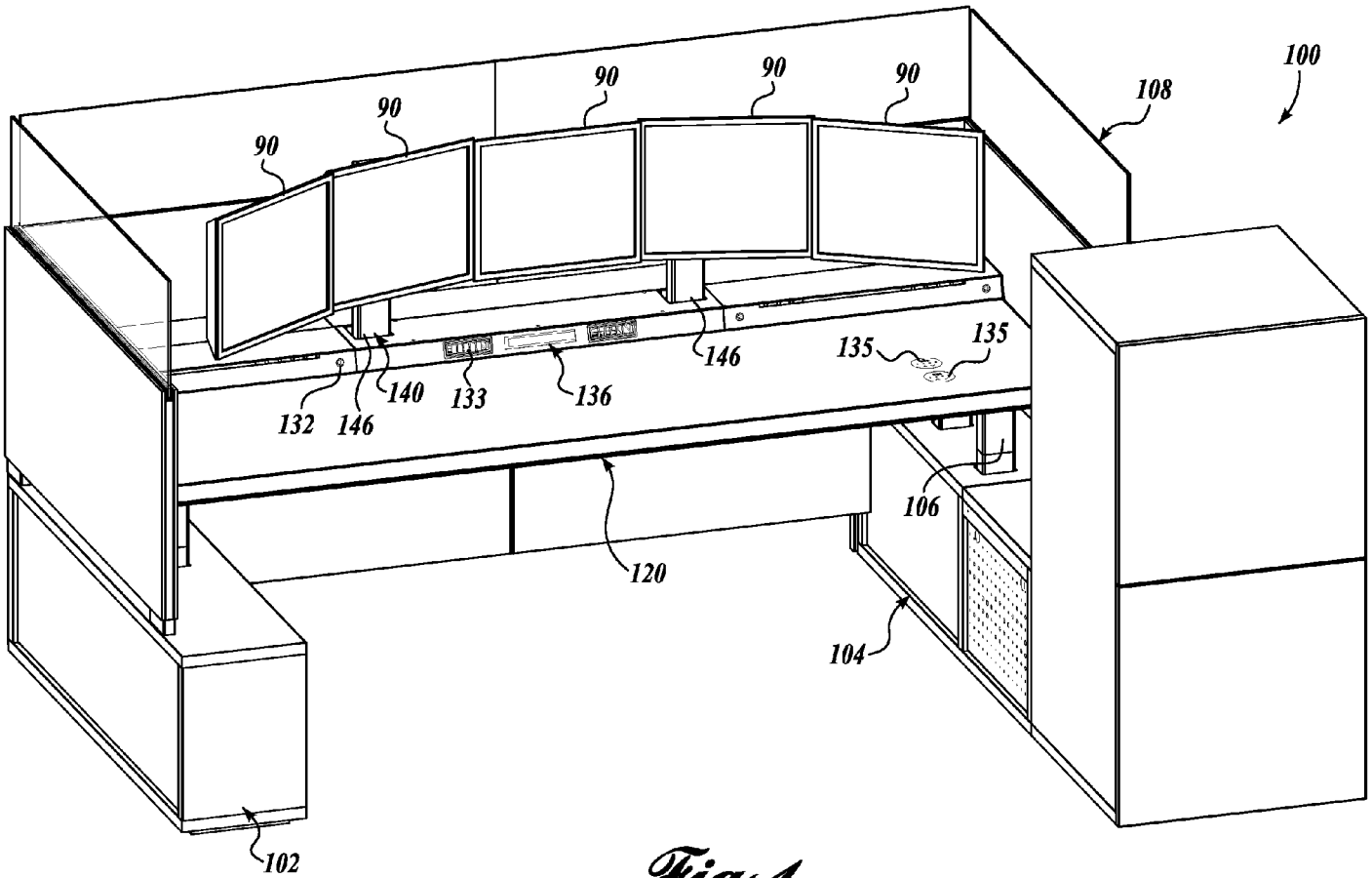
FIG. 1 is an environmental view showing a workstation in accordance with the present invention.
Figure 2:
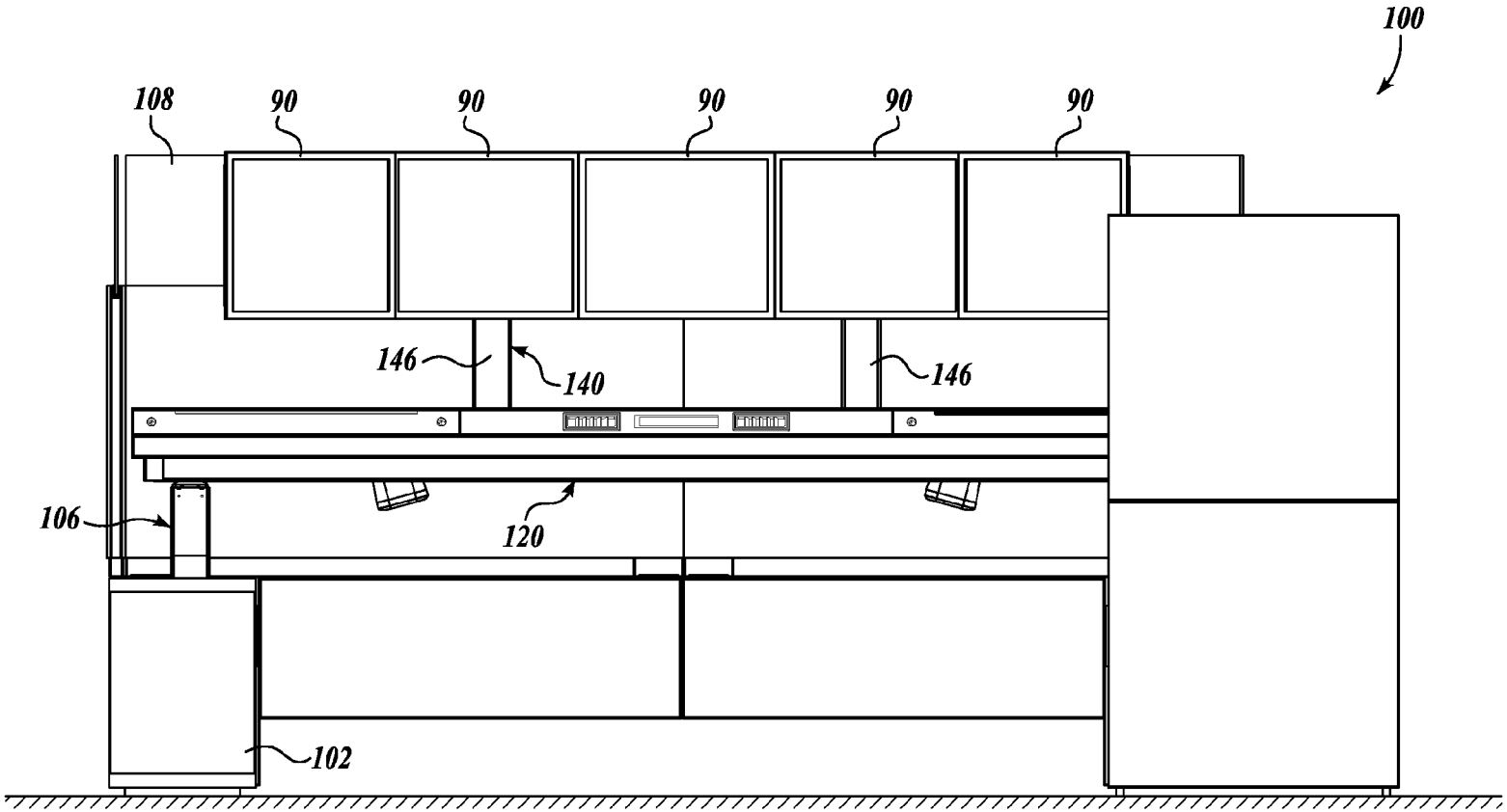
FIG. 2 is a front view of the workstation shown in FIG. 1.
Figure 3:
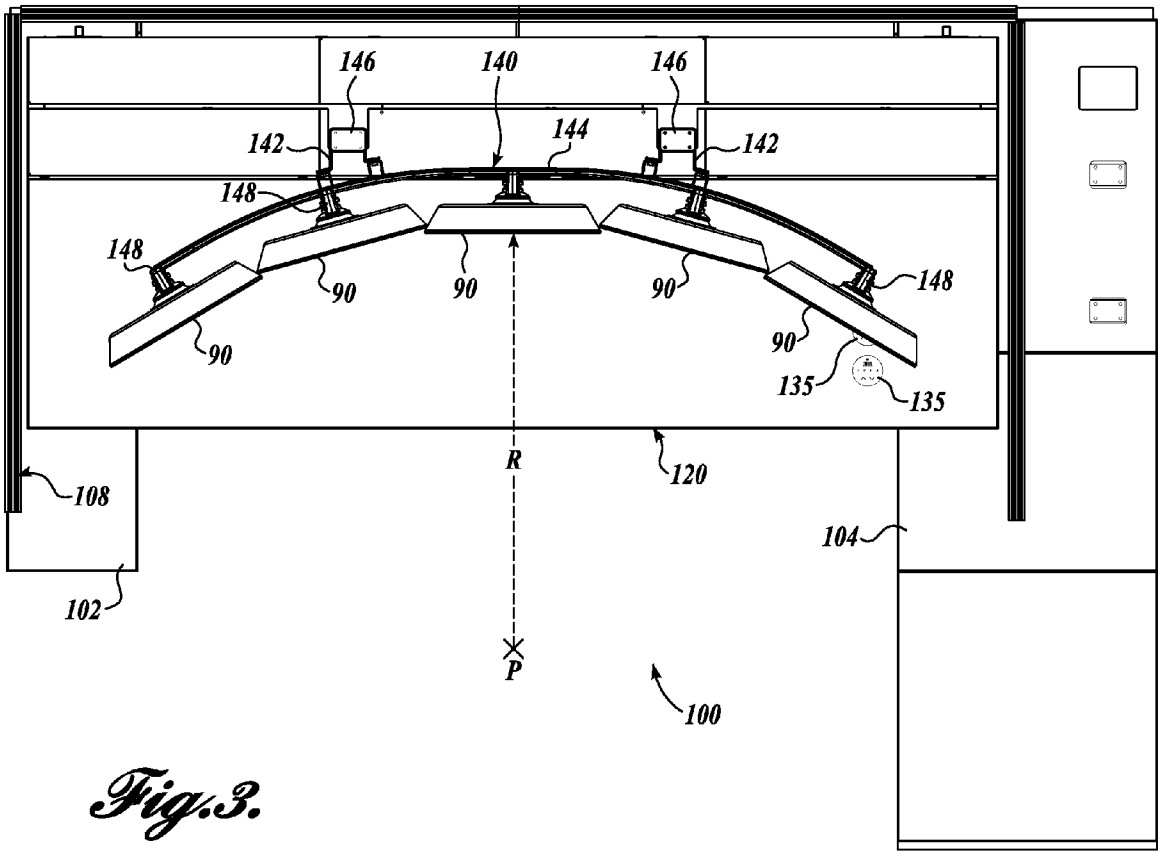
FIG. 3 is a plan view of the workstation shown in FIG. 1.

A current embodiment of a workstation 100 in accordance with the present invention will now be described, with reference to the FIGURES, wherein like numbers indicate like parts. FIG. 1 is a perspective environmental view of a fully assembled workstation 100, including optional storage and privacy components; FIG. 2 is a front view of the workstation 100; and FIG. 3 is a plan view of the workstation 100.

The workstation 100 includes a height-adjustable and horizontally adjustable work surface assembly 120. The work surface assembly 120 is adjustably attached to a left base assembly 102 and a right base assembly 104 through four telescoping lifting columns 106 (one visible in FIG. 1). The lifting columns 106 are preferably motorized and may be any suitable lifting column, including, for example, the three-part lifting column linear actuator marketed under the DL6 DESKLIFT™ mark and sold by Linak A/S, a corporation of Denmark. An optional sound-absorbing privacy screen assembly 108 extends around the back and lateral sides of the work surface assembly 120.

A monitor support structure 140 is attached to the work surface assembly 120, and is configured to support a plurality of conventional monitors 90 (five shown). In this embodiment, the monitor support structure 140 includes a pair of spaced-apart lifting columns 146, for example, Linak A/S DL5 DESKLIFT™ two-part lifting column linear actuators. The monitor support structure 140 is only height adjustable and is not adjustable in a horizontal plane. It should be appreciated that the design of the monitor support structure 140 is significantly simplified by providing only vertical adjustability because the support structure 140 is not required to accommodate the dynamic loads associated with lateral movement of the monitors 90. In addition, the risk of monitors 90 becoming inadvertently detached from the monitor support structure 140 is significantly reduced, improving the workstation 100 reliability.

The lifting columns 146 cooperatively support a curved horizontal bar 144 (FIG. 3) that attaches to the lifting columns 146 with U-shaped brackets 142. Each of the monitors 90 are attached to the curved horizontal bar 144 with associated monitor brackets 148 that engage the back of the monitors 90. As most clearly seen in FIG. 3, the monitor support structure 140 mounts the plurality of monitors 90 along an arcuate or circular arc such that the plurality of monitors 90 are approximately the same distance R from a location P in front of the workstation 100. Therefore, a user seated at the location P would have approximately the same focal length R to each of the monitors 90. For example, a user located at P (e.g., the approximate location of the user's eyes looking towards the monitors 90) might have a variation in the distance R from P to the center of each monitor that does not vary by more than 2 inches. Moreover, the working surface assembly lifting columns 106 enable the user to adjust the height of the working surface and the monitor support structure lifting columns 146 enable the user to independently adjust the monitor 90 height and work surface 120 height, to provide optimal ergonomic benefit and minimize eye strain. In a current embodiment, a pair of electronic control panels 135 are recessed in working surface assembly 120 and operatively connected to the lifting columns 106, 146, for adjusting the height of the working surface assembly 120 and the height of the monitors 90.

Figure 4:
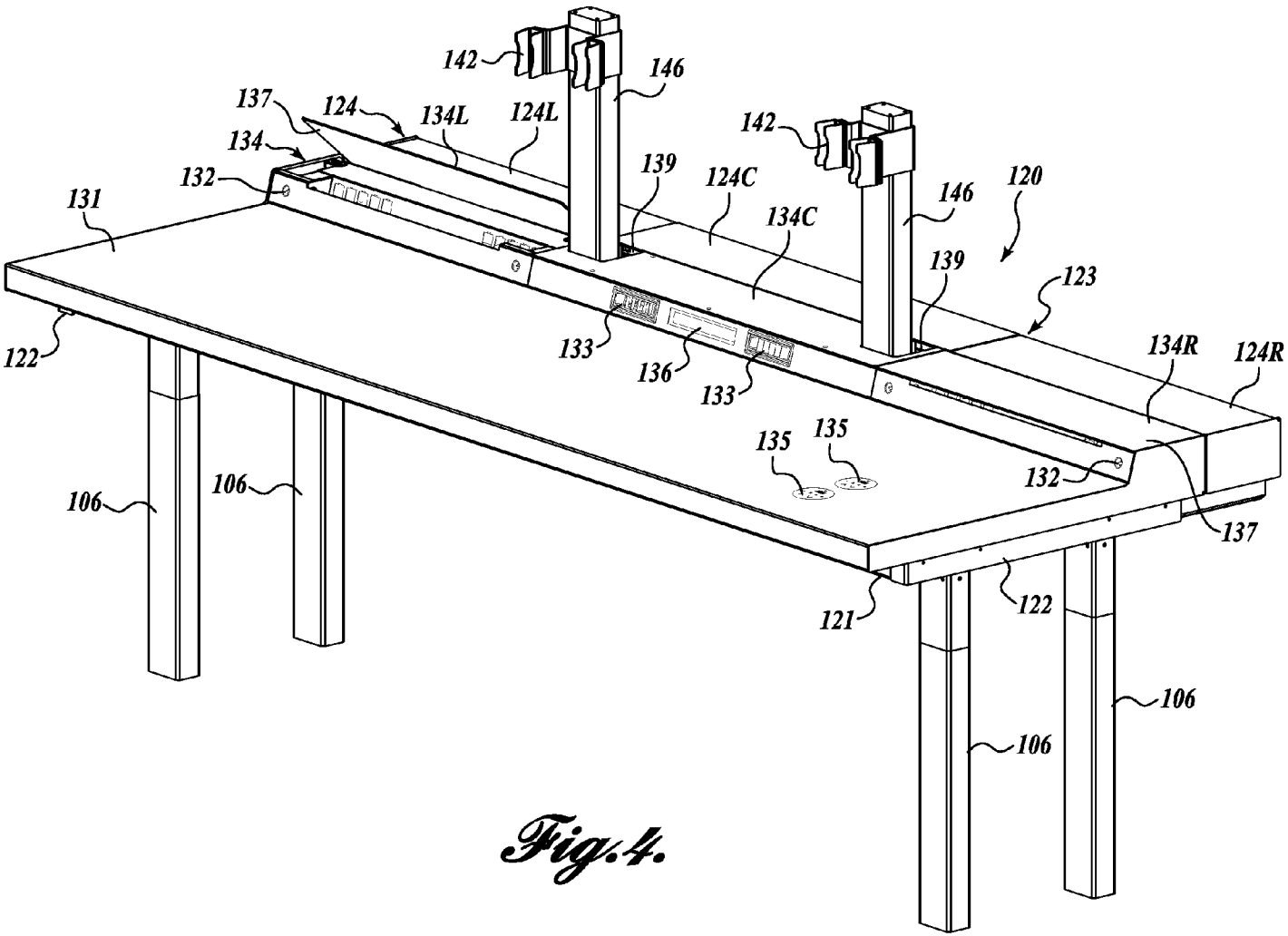
FIG. 4 is a perspective view showing the desk portion of the workstation shown in FIG. 1, with the upper work surface shown in the fully retracted position.

A perspective view of the work surface assembly 120 supported on the lifting columns 106 is shown in FIG. 4. The work surface assembly includes a generally horizontal lower support structure 121 that is supported by the lifting columns 106. An upper work surface 131 is mounted to the lower support structure 121 with a pair of heavy duty slides 122 attached on the left and right sides of the work surface assembly 120. the slides 122 suspend the upper work surface 131 over the lower support structure 121 such that a forward/rearward position of the upper work surface 131 can be adjusted with respect to the lower support structure 121. The upper work surface 131 is shown in FIG. 4 in the closed or fully retracted position.

The workstation 100 also includes a bifurcated utility bar, referred to herein as a dashboard assembly 123. The dashboard assembly 123 is defined cooperatively by a back dashboard assembly 124 that extends upwardly from a back portion of the lower support structure 121, and a front dashboard assembly 134 that is fixed to a back portion of the movable upper work surface 131. The back dashboard assembly 124 is therefore fixed, and the front dashboard assembly moves forward and rearward with the upper work surface 131. When the upper work surface 131 is in the fully retracted position shown in FIG. 4, the front dashboard assembly 134 is adjacent the back dashboard assembly 124.

The back dashboard assembly 124 provides an enclosure defining an interior volume that is preferably at least partially accessible to the user. In a current embodiment, the back dashboard assembly 124 includes a left enclosure 124L, a right enclosure 124R, and a center enclosure 124C. The left and right enclosures 124L, 124R have an upper panel that is hingedly attached to the enclosure to provide access to the enclosed volume. The back dashboard assembly 124 encloses components for the workstation 100, including, for example, power strips (not shown) for the monitors 90, lifting columns 106, 146, computers, and other equipment. The back dashboard assembly 124 may also enclose control hardware for the workstation 100, for example, control systems to allow the user to adjust the height and/or horizontal position of the upper work surface 131.

The front dashboard assembly 134 moves with the upper work surface 131 and provides enclosures and front panels for various workstation 100 components. Preferably, at least some of the volume enclosed by the front dashboard assembly 134 is accessible to the user. In the current embodiment, the front dashboard assembly 134 includes a left enclosure 134L, a right enclosure 134R, and a center enclosure 134C. The front dashboard assembly 134 encloses equipment and outlets that are beneficially fixed with respect to the upper work surface 131. For example, the front dashboard assembly 134 provides externally accessible connectors 132, for example, power outlets, speaker jacks, headphone jacks, and/or microphone jacks. Other peripheral equipment that may be incorporated into the front dashboard assembly 134 include user lighting, memory ports such as universal serial bus ports, CD and/or DVD players and the like, biometric or other user-verification equipment, teleconferencing video cameras, proximity sensors, and the like. The front dashboard assembly 134 in this embodiment also includes a status display 136 that displays information regarding the current adjustment of the workstation 100, such as the work surface 131 height or the like.

In a current embodiment, the left and right enclosures 134L, 134R house power strips (not shown), and the upper panel 137 on the left and right enclosures 134L, 134R are hingedly attached, providing the user with easy access to the power outlets. The center enclosure 134C houses one or more controllable user fans 133. As seen most clearly in FIG. 4, the center enclosure 134C is also configured with recesses or channels 139 that are positioned and sized to accommodate the lifting columns 146 that adjustably support the monitors 90, as discussed above. Therefore, the upper work surface 131 can slide forward and backward without interference from the monitor support structure 140.

Figure 5:
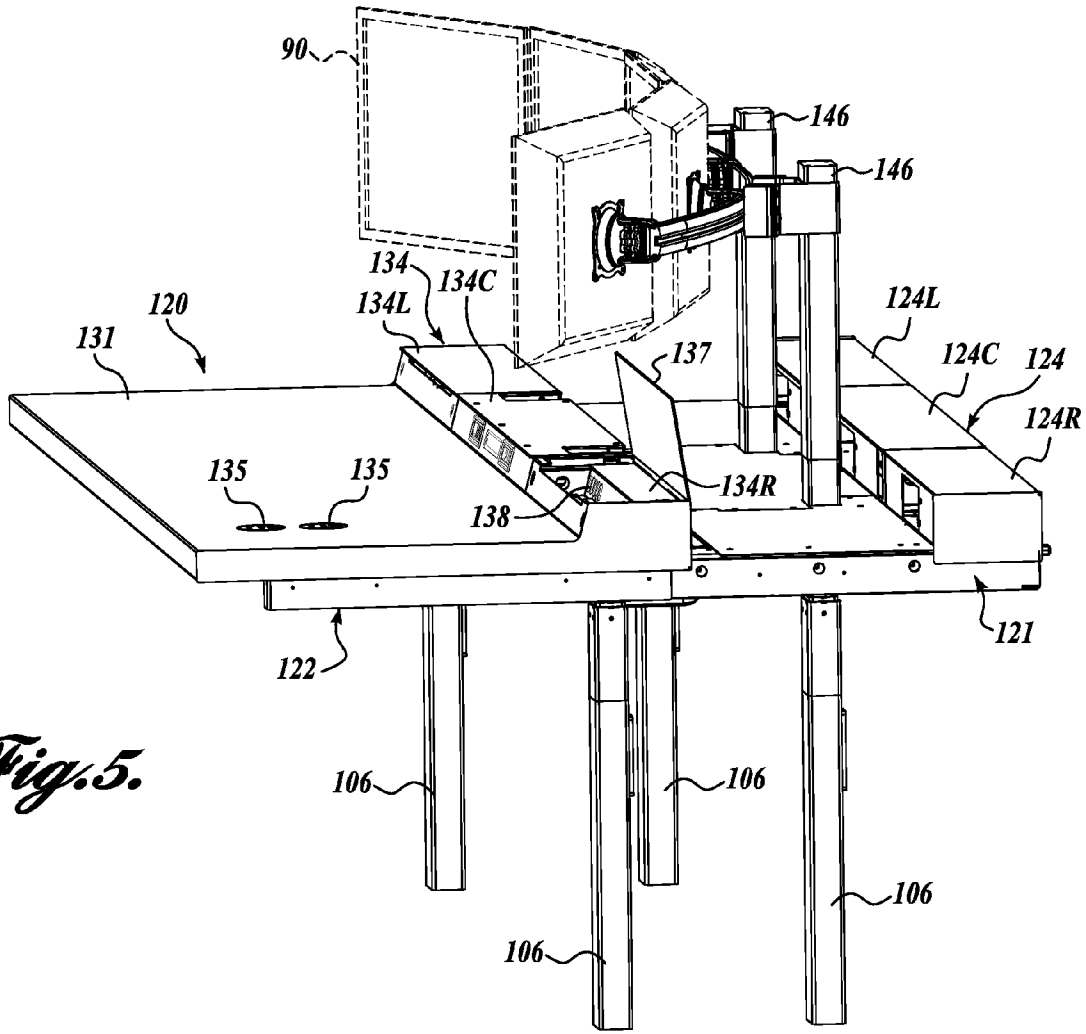
FIG. 5 is a perspective side view showing the desk portion of the workstation shown in FIG. 1, with the upper work surface shown in the fully extended position.

A perspective side view of the work surface assembly 120 supported on the lifting columns 106 is shown in FIG. 5, with the upper work surface 131 in the fully extended position, and monitors 90 shown in phantom. It will now be appreciated that the user can adjust the user's focal length R (FIG. 3) with respect to the monitors 90 by slidably adjusting the upper work surface 131, thereby adjusting the user's position P (FIG. 3). The upper panel 137 for the right enclosure 134R of the front dashboard assembly 134 is shown in the opened position, providing the user access to the enclosed power strip 138.

The front dashboard assembly 134 provides a raised stop or barrier on the upper work surface 131, which guards against objects on the upper work surface 131 being pushed off the back of the surface, and also providing a visual environment that is relatively consistent, even when the upper work surface is moved between the fully retracted and fully extended positions. Moreover, devices on the upper work surface that plug into, or otherwise interface with components on or in the front dashboard assembly 134 are not disturbed and do not need to be adjusted or unplugged when moving the upper work surface 131. In a current embodiment, a locking mechanism (not shown) is provided for releasably locking the upper work surface 131 in a desired extension position.

Figure 6:
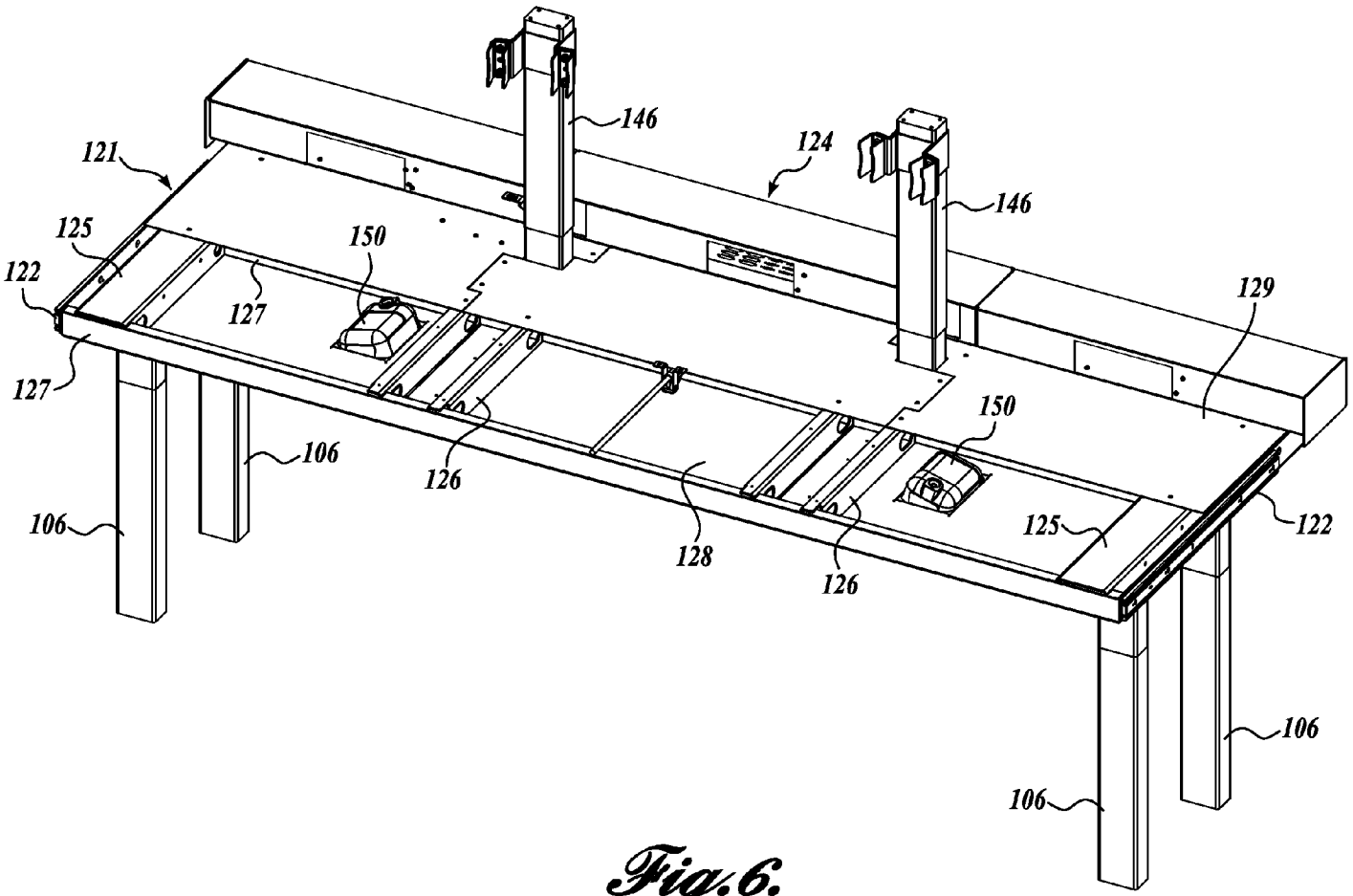
FIG. 6 is a perspective view showing the lower support structure for the workstation shown in FIG. 1.

FIG. 6 is a perspective view showing the lower support structure 121. In the current embodiment, the lower support structure 121 includes two outboard beams 125 that each define an inverted U-shaped longitudinal channel sized to receive and attach the upper end of the lifting columns 106 including the drive motor for the lifting columns 106. The slide assemblies 122 attach to the outer side of the outboard beams 125. The support structure 121 further includes two interior beams 126 that define U-shaped channels sized to receive and attach the lifting columns 146 for the monitor support structure 140. Three transverse structural members 127 (two visible) join the beams 125, 126, and in a current embodiment comprise rectangular tubular members. A floor panel 128 is fixed to the bottom of the beams 125, 126 and structural members 127, and an optional upper panel assembly 129 covers the rearward portion of the support lower structure 121, producing a relatively strong and rigid box support structure. Optional personal heaters 150 may be installed in the lower support structure 121 for user comfort.

It will now be appreciated that a user may obtain optimal ergonomic adjustment of the workstation, including monitor height and focal distance, by using one of the control panels 135 to adjust the work surface assembly 120 to a desired height, using the other of the control panels 135 to adjust the monitor 90 height to a desired level, and then slidably adjusting the horizontal position of the upper work surface 131 to obtain a desired focal distance to the monitors 90, and locking the upper work surface 131 in place.

Although a currently preferred embodiment of a workstation in accordance with the present invention has been described in detail, to better understand the present invention, it will be appreciated that the invention is not restricted to the particular details of the present embodiment. For example, it is contemplated that the dashboard assembly 123 may comprise only a forward dashboard assembly, and/or the dashboard assembly may not allow user access to the enclosed volume. It is also contemplated that the horizontal position of the upper work surface 131 may be provided with a motorized or power-assisted means for moving the upper work surface 131 between the retracted and extended positions. It is contemplated that the upper work surface may be slidably connected to the lower support structure 121 by alternative means, including, for example, with wheels disposed on the bottom of the work surface, a track, or other low friction supports disposed between the upper work surface and the lower support structure, or the like. Although the upper work surface 131 is described as moving horizontally, it is contemplated that the upper work surface may be disposed at an angle, which may be adjustable. It is contemplated that more or fewer monitors may be mounted to the monitor support structure 140, and may be spaced apart and/or disposed at different elevations.

While illustrative embodiments have been illustrated and described, it will be appreciated that various changes can be made therein without departing from the spirit and scope of the invention.

The embodiments of the invention in which an exclusive property or privilege is claimed are defined as follows:

1. A workstation with height and focal distance adjustability comprising:

a plurality of first lifting columns;

a lower support structure supported by the plurality of first lifting columns;

an upper work surface slidably suspended over the lower support structure;

a monitor support assembly comprising a curved transverse support and a second lifting column having a first end fixed to the lower support structure and a second end fixed to the curved transverse support; and a utility enclosure assembly comprising a first portion attached to a back portion of the upper work surface;

wherein the plurality of first lifting columns adjust an elevation of the upper work surface, the second lifting column adjusts an elevation of the curved transverse support, and the upper work surface is slidably adjustable.

2. The workstation of claim 1, wherein a horizontal position of the curved transverse support is fixed with respect to the lower support structure.

3. The workstation of claim 1, wherein the upper work surface is slidably attached to the lower support structure with a left slide having a first portion fixed to a left side of the lower support structure and a second portion fixed to the upper work surface, and a right slide having a first portion fixed to a right side of the lower support structure and a second portion fixed to the upper work surface.

4. The workstation of claim 1, wherein the upper work surface further comprises a first control panel that is operatively connected to control the plurality of first lifting columns, and a second control panel that is operatively connected to control the second lifting column.

5. The workstation of claim 1, wherein the utility enclosure assembly includes a second portion attached to the upper work surface that defines a user-accessible enclosure that moves with the upper work surface.

6. The workstation of claim 5, wherein the utility enclosure assembly encloses a first power strip that is fixed with respect to the upper work surface.

7. The workstation of claim 5, wherein the utility enclosure assembly comprises an externally accessible connector that is functionally connected to a device disposed in the enclosure.

8. The workstation of claim 5, wherein the utility enclosure assembly comprises a left enclosure and a right enclosure.

9. The workstation of claim 8, wherein the left enclosure and the right enclosure each comprise an upper hinged panel portion.

10. The workstation of claim 1, wherein the lower support structure comprises two outboard beams that each define an inverted U-shaped channel configured to receive an upper end of at least one of the plurality of first lifting columns, and an interior beam defining a U-shaped channel configured to receive a lower end of the second lifting column.

11. The workstation of claim 1, wherein the monitor support assembly is configured to mount a plurality of monitors along a substantially circular arc.

12. An ergonomic workstation comprising:

a plurality of first lifting column linear actuators adjustably supporting a lower support structure;

a work surface attached to the lower support structure with a plurality of slides;

a curved monitor support and a second lifting column linear actuator having a first end attached to the lower support structure, and a second end attached to the curved monitor support; and a dashboard assembly comprising a front portion attached to a back end of the work surface and a back portion attached to a back end of the lower support structure;

wherein the plurality of first lifting column linear actuators are configured to adjust an elevation of the work surface, and the second lifting column linear actuator is configured to adjust a horizontal position of the curved monitor support.

13. The workstation of claim 12, wherein the horizontal position of the curved monitor support is fixed with respect to the lower support structure.

14. The workstation of claim 12, wherein the work surface is slidably attached to the lower support structure with a left slide having a first portion fixed to a left side of the lower support structure and a second portion fixed to the work surface, and a right slide having a first portion fixed to a right side of the lower support structure and a second portion fixed to the work surface.

15. The workstation of claim 12, wherein the upper work surface further comprises a first control panel that is operatively connected to control the plurality of first lifting column linear actuators, and a second control panel that is operatively connected to control the second lifting column linear actuator.

16. The workstation of claim 12, wherein the dashboard assembly defines a first enclosure that is in a fixed position with respect to the work surface.

17. The workstation of claim 16, wherein the first enclosure contains a power strip.

18. The workstation of claim 16, wherein the dashboard assembly further defines a plurality of externally accessible connectors that engage corresponding devices disposed in the first enclosure.

19. The workstation of claim 16, wherein the dashboard assembly further defines a second enclosure that is fixedly attached to a back portion of the lower support structure, wherein the second enclosure is not in a fixed position with respect to the work surface.

20. The workstation of claim 12, wherein the lower support structure comprises two outboard beams that each define an inverted U-shaped channel configured to receive an upper end of at least one of the plurality of first lifting column linear actuators, and an interior beam defining a U-shaped channel configured to receive a lower end of the second lifting column linear actuator.

* * * * *